US012371909B2

(12) United States Patent
Smith

(10) Patent No.: US 12,371,909 B2
(45) Date of Patent: Jul. 29, 2025

(54) ROOFING SHINGLE DELIVERY SYSTEM

(71) Applicant: Dwight Smith, Bedford Heights, OH (US)

(72) Inventor: Dwight Smith, Bedford Heights, OH (US)

( * ) Notice: Subject to any disclaimer, the term of this patent is extended or adjusted under 35 U.S.C. 154(b) by 986 days.

(21) Appl. No.: 17/329,524

(22) Filed: May 25, 2021

(65) Prior Publication Data

US 2022/0381034 A1 Dec. 1, 2022

(51) Int. Cl.
*E04D 15/07* (2006.01)
*E04D 15/02* (2006.01)
*E04G 3/26* (2006.01)

(52) U.S. Cl.
CPC ..... *E04D 15/07* (2013.01); *E04D 15/02* (2013.01); *E04G 3/265* (2013.01)

(58) Field of Classification Search
CPC ..... E04D 15/00; E04D 15/003; E04D 15/006; E04D 15/06; E04D 15/07; E04D 15/02; E04G 3/265; E04G 3/26; E04G 3/34
See application file for complete search history.

(56) References Cited

U.S. PATENT DOCUMENTS 403,636 A * 5/1889 Bitterly ..... E06C 1/397 182/20
472,867 A * 4/1892 Farland ..... E04G 3/26 248/237
643,845 A * 2/1900 Kuhn ..... E04G 3/26 248/237
673,065 A * 4/1901 Scott ..... E06C 1/397 182/20
674,170 A * 5/1901 Kuhn ..... E04G 3/26 248/237
829,312 A * 8/1906 Alberty ..... E04G 3/26 248/237
909,012 A * 1/1909 McCarty ..... E04G 3/26 248/237
956,406 A * 4/1910 Nowodworski ..... E04G 3/26 182/45
980,618 A * 1/1911 Douglas ..... E04G 3/26 248/237
988,808 A * 4/1911 Parris ..... E04G 3/265 182/45
1,028,362 A * 6/1912 King ..... E04G 3/26 248/237
1,148,919 A * 8/1915 Nielsen ..... E04G 3/26 248/237
1,222,053 A * 4/1917 Watson ..... E04G 3/26 248/237
1,248,228 A * 11/1917 West ..... E06C 1/397 182/20

(Continued)

*Primary Examiner* — Daniel P Cahn
*Assistant Examiner* — Shiref M Mekhaeil
(74) *Attorney, Agent, or Firm* — Daniel M. Cohn; Howard M. Cohn

(57) ABSTRACT

A roofing shingle delivery system for supporting a pallet on a peaked roof. The system includes a pair of adjustable brackets adapted to support the pallet on the peaked roof. Each of the pair of brackets includes a horizontal upper member. Each of the pair of brackets includes a first lower supporting brace and a second lower supporting brace. The first lower supporting brace and the second lower supporting brace are arranged to be disposed directly on opposite sides of the peaked roof.

7 Claims, 7 Drawing Sheets

(56) References Cited

U.S. PATENT DOCUMENTS 1,365,996 A * 1/1921 Herwick ..... E04G 3/265
248/237
1,770,097 A * 7/1930 Bede ..... E04G 3/26
248/237
2,448,746 A * 9/1948 Sundeen ..... E04G 3/265
182/45
3,058,542 A * 10/1962 Rogalla ..... E06C 1/39
182/155
3,164,353 A * 1/1965 Rene ..... E04G 3/265
248/237
5,249,397 A * 10/1993 Monaco ..... E04G 3/265
52/126.1
5,318,148 A * 6/1994 Franco ..... E04G 3/26
248/237
5,474,271 A * 12/1995 Raymond ..... E04G 3/26
248/237
5,960,904 A * 10/1999 Ullmann ..... E04G 3/265
248/237
6,269,905 B1 * 8/2001 Smith ..... E04G 3/26
248/237
6,932,191 B1 * 8/2005 Schwenk ..... E04G 5/041
248/237
7,874,451 B2 * 1/2011 Bel ..... E04D 15/00
220/628
8,939,415 B2 * 1/2015 Dillinger ..... F16M 13/02
248/237
9,010,010 B2 * 4/2015 Dreiband ..... F41A 35/00
42/98
9,587,408 B1 * 3/2017 Brannon ..... B25H 3/02
10,550,588 B2 * 2/2020 Smith ..... E04G 21/166
10,864,625 B2 * 12/2020 Hanlon ..... B25H 1/06
10,865,012 B2 * 12/2020 Smith ..... E04G 21/14
11,008,763 B2 * 5/2021 Bendall ..... E04G 3/22
11,512,480 B1 * 11/2022 Achor ..... H02S 20/23
2009/0229213 A1 * 9/2009 Mistelski ..... E04D 15/02
248/237
2010/0213005 A1 * 8/2010 Sistonen ..... E04G 3/265
248/237
2015/0021452 A1 * 1/2015 Bourbonnais ..... B65D 19/0095
248/544
2016/0160514 A1 * 6/2016 Ashman ..... E04G 3/265
182/130
2019/0264452 A1 * 8/2019 Cangelosi ..... E04G 3/265

* cited by examiner

ROOFING SHINGLE DELIVERY SYSTEM

TECHNICAL FIELD OF THE INVENTION

The present invention relates to a roofing shingle delivery device for supporting a pallet on a peaked roof, and more particularly a pair of brackets adapted to support the pallet on the peaked roof.

BACKGROUND OF THE INVENTION

In the roofing industry, bundles of roofing shingles are loaded onto wooden pallets by the manufacturers of such shingles. A loaded pallet is typically 36"×48" and weighs up to 4,000 lbs. The pallets are then transported by truck from a warehouse to the building site. At the building site, the loaded pallets are then lifted by a conveyor, crane or fork-lift to the roof. Usually, the loaded pallet is supported by the crane or the like above the ridge of the roof and the shingles are unloaded on either side of the pallet by an unloading crew on the roof who stack the shingles on the roof on both sides of the ridge.

The unloading operation is time consuming and labor intensive. Moreover, when ice or snow is present on the roof, it is not safe to have an unloading crew on the roof. Roofers are continually faced with the problem of supporting bundles of shingles on a sheeted roof where the weight of the load of shingles may be in the order of 1000 to 4000 pounds. In the past, the practice has been to use the bundles of shingles themselves when laid on either side of the ridge to form the base for a horizontal platform, for example, of plywood to provide a stable platform for storing further bundles of shingles thereon. This has drawbacks including potential stability problems.

SUMMARY OF THE INVENTION

According to an embodiment of the present invention, there is disclosed a roofing shingle delivery system for supporting a pallet on a peaked roof. The roofing shingle delivery system includes a pair of brackets adapted to support the pallet on the peaked roof. Each of the pair of brackets includes a horizontal upper member. Each of the pair of brackets includes a first lower supporting brace and a second lower supporting brace. The first lower supporting brace and the second lower supporting brace are arranged to be disposed directly on opposite sides of the peaked roof, respectively.

According to another embodiment of the present invention, there is disclosed a roofing shingle delivery system for supporting a pallet on a peaked roof. The roofing shingle delivery system includes a pair of brackets adapted to support the pallet on the peaked roof. Each of the pair of brackets includes a horizontal upper member comprised of an upper platform, having first and second ends, each with vertically extending lips, and a strut. Each of the pair of brackets includes a first lower supporting brace secured below the first end of the upper platform and a second lower supporting brace secured below the second end of the upper platform. The first lower supporting brace is comprised of a first vertical section, an angled section, and a second vertical section, and the second lower supporting brace is comprised of a first vertical section, an angled section, and a second vertical section. The first lower supporting brace and the second lower supporting brace are arranged to be disposed directly on opposite sides of the peaked roof, respectively.

According to another embodiment of the present invention, there is disclosed a roofing shingle delivery system for supporting a pallet on a roof. The roofing shingle delivery system comprises a pair of adjustable brackets adapted to support the pallet on the peaked roof. Each of the pair of adjustable brackets include an upper member, a first lower support brace pivotally mounted to the upper member and a second lower supporting brace pivotally mounted to the upper member so that the first lower support brace and the second lower support brace are arranged to be seated on opposite sides of the roof. First and second struts are mounted to pivotally connect the upper member to the first lower support brace and to the second lower support brace. A first support member is pivotally connected to the upper member and pivotally connected to the first lower support brace and a second support member pivotally connected to the upper member and pivotally connected to the second lower support brace.

According to another embodiment of the present invention, there is disclosed a roofing shingle delivery system for supporting a pallet on a roof. A pair of adjustable brackets are adapted to support the pallet on the peaked roof. Each of the pair of adjustable brackets include an upper member. A first lower support brace is pivotally mounted to the upper member and a second lower supporting brace pivotally mounted to the upper member so that the first lower support brace and the second lower support brace are arranged to be seated on opposite sides of the roof. First and second struts mounted to pivotally connect the upper member to the first lower support brace and to the second lower support brace. A first support member pivotally connected to the upper member and pivotally connected to the first lower support brace and a second support member pivotally connected to the upper member and pivotally connected to the second lower support brace. An angle X between the first and second support brace can be adjusted by changing the length of the first and second support members.

BRIEF DESCRIPTION OF THE DRAWINGS

The structure, operation, and advantages of the present invention will become further apparent upon consideration of the following description taken in conjunction with the accompanying figures (FIGS.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

DETAILED DESCRIPTION OF THE PREFERRED EMBODIMENTS

Figure 1:
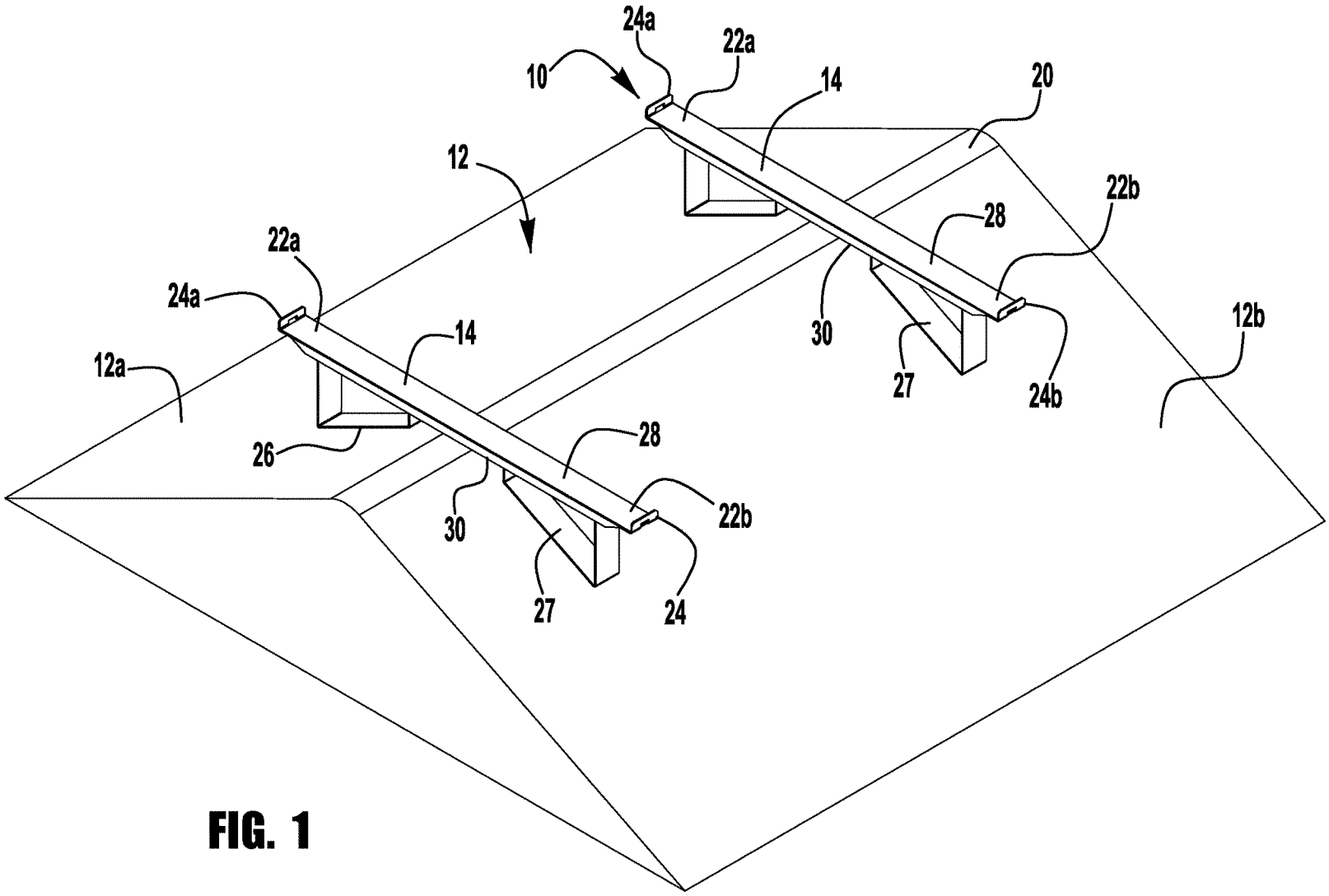
FIG. 1 is a front three-dimensional view of a first embodiment of a roofing shingle delivery system on a roof of a house, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader and should not in any way be interpreted as limiting.

Pallets are well known in the art, as a cost-effective means of stacking materials for storage, and moving the stacked materials from one place to another by transporting the pallets with a dedicated pallet transporter, for example forklifts or boom trucks. In the context of rooftop construction, pallets are used to store and transport shingles. Roofing shingles are generally packaged in bundles that are stored and shipped on pallets. The pallets may be initially stored at a warehouse, and then transported to the location where rooftop construction is occurring. Pallets loaded with bundles of roofing shingles are transported by trucks from warehouses to the worksites and the individual shingle bundles are hauled up to the roofs by a conveyor or the pallets loaded with the shingle bundles are lifted up by a crane or forklift. It must be noted that the pallets may also be used for accommodating terracotta tiles, slate tiles, rolls of membrane, etc.

In the case of lifting pallets up to a roof by a crane or forklift the individual bundles of shingles are unloaded from the pallets manually by workers and resting the pallet on the rooftop. Traditionally, in cases where the rooftop has an inverted V shape, a pallet cannot be delivered to rest on the rooftop, since a pallet can only be resting on a substantially planar surface. Thus, the upper surface of the rooftop is typically not flat and it is not possible to rest the pallet on the rooftop in a secure manner.

Figure 3:
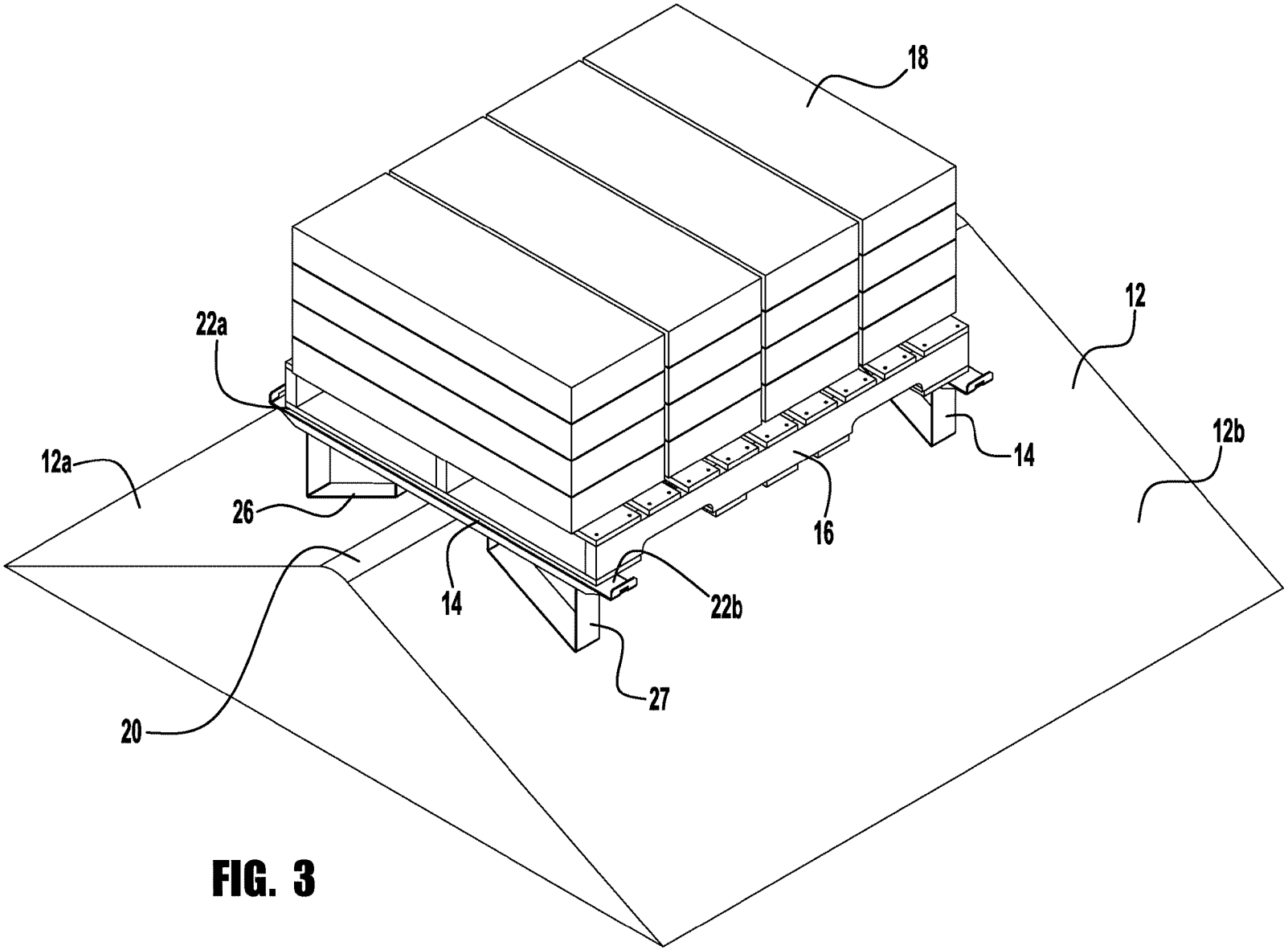
FIG. 3 is a three-dimensional view of the first embodiment of the roofing shingle delivery device in use with a pallet disposed thereon, in accordance with the present invention.

The roofing shingle delivery system 10 is designed to provide is a bracket system to sit directly on the peak of a peaked roof 12. In general terms, a pair of brackets 14 is disposed on the peaked roof of a house where roofing work is being done. It is within the terms of the embodiment that the pair of brackets 14 be interconnected, such as with a supporting brace connected at either end to the brackets. However, as illustrated, the pair of brackets 14 are independent from each other. The brackets 14, comprising the roofing shingle delivery system 10, are designed to support a traditional pallet 16 containing the roofing shingles 18, as shown in FIG. 3. As seen in FIG. 1, each of the brackets 14 are disposed by straddling the peak or ridge 20 of a roof 12 with opposite sides of the present resting on opposite sides 12*a* and 12*b* of the roof.

Each of the pair of brackets 14 are made of a rigid material, such as for example metal, wood, plastic, or rigid cardboard. Alternatively, the brackets 14 may be made of a biodegradable material, such as for example a wood species easily biodegradable, a biodegradable plastic or a biodegradable cardboard.

Figure 2:
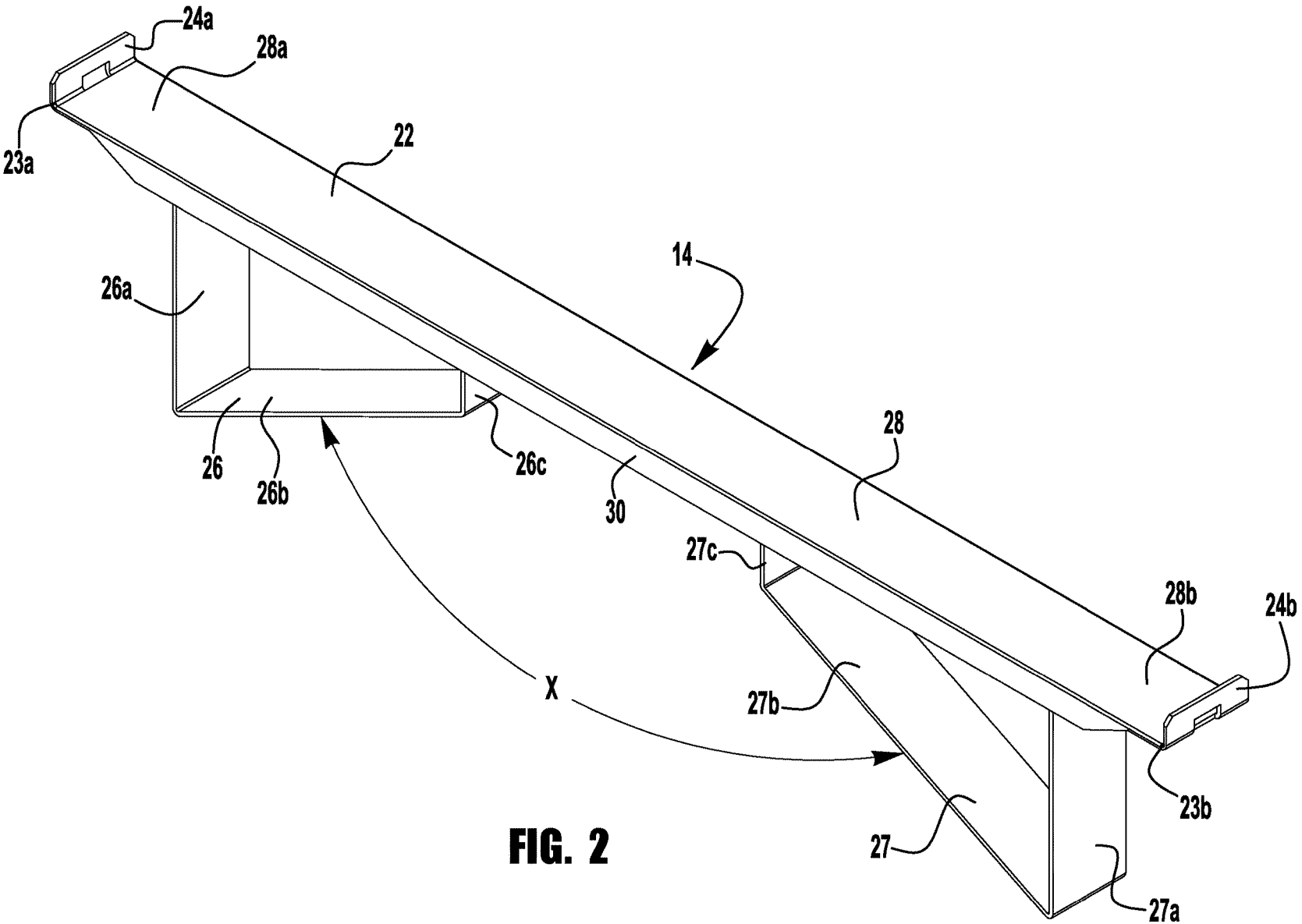
FIG. 2 is a front three-dimensional view of one of the pair of brackets of the first embodiment of a roofing shingle delivery device, in accordance with the present invention.

As illustrated in FIG. 2, each of the pair of brackets 14 is comprised of a horizontal upper member 22, a first lower supporting brace 26 and a second lower supporting brace 27. The first lower supporting brace 26 and the second lower supporting brace 27 are disposed directly on the opposite sides 12*a* and 12*b* of the roof 12, respectively. The pallet 16 containing the roofing shingles 18 is temporarily placed atop the horizontal upper member 22 of each of the pair of brackets 14.

The horizontal upper members 22 may have any appropriate dimensions to accommodate the pallet 16. Each horizontal upper member 22 is comprised of an upper platform 28, and strut 30 that is disposed directly below and perpendicular to the upper platform. Each of the upper platforms 28 has first and second ends 28*a* and 28*b*. There is a vertically extending lip 24*a* and 24*b* that extends upward from the edges 23*a* and 23*b* of the first and second ends 28*a* and 28*b*, respectively. The upward extending lips 24*a* and 24*b* are designed to keep the pallet 16 secured in place when placed upon the upper platforms 28 of the brackets 14.

The first lower supporting brace 26 is disposed below the first end 28*a* of the upper platform 28 and is secured thereto. The first lower supporting brace 26 is comprised of a first vertical section 26*a*, an angled section 26*b*, and a second vertical section 26*c*. The first vertical section 26*a* and second vertical section 26*c* are mounted to the strut 30. The first vertical section 26*a* and the second vertical section 26*b* are parallel to each other and are joined together with the angled section 26*b*.

The second lower supporting brace 27 is disposed below the second end 28*b* of the upper platform 28 and secured thereto. The second lower supporting brace 27 is comprised of a first vertical section 27*a*, an angled section 27*b*, and a second vertical section 27*c*. The first vertical section 27*a* and second vertical section 27*c* are mounted to the strut 30. The first vertical section 27*a* and the second vertical section 27*b* are parallel to each other and are joined together with the angled section 27*b*.

The brackets 14 are customizable to be functional on a variety of roofs 12 having various levels of pitch. The angled section 26*b* of the first lower supporting brace 26 and the angled section 27*b* of the second lower supporting brace 27 have an angle of X degrees between them. The angle X is adjustable to accommodate various pitches of the opposite sides 12*a* and 12*b* of the roof 12. To adjust the angle X, each of the angled sections 26*b* and 27*b* may be customized.

For example, the angled sections 26*b* and 27*b* may be lengthened or shortened to accommodate the specific pitch of the roof 12. Each of the first lower supporting brace 26 and the second lower supporting brace 27 are disposed relative to the other to form an angle of a range of angles from 0 to 180 degrees, thereby forming a selected angle between the sections 26*b* and 27*b* which corresponds to the angle defined by the roof peak 20.

Figure 4:
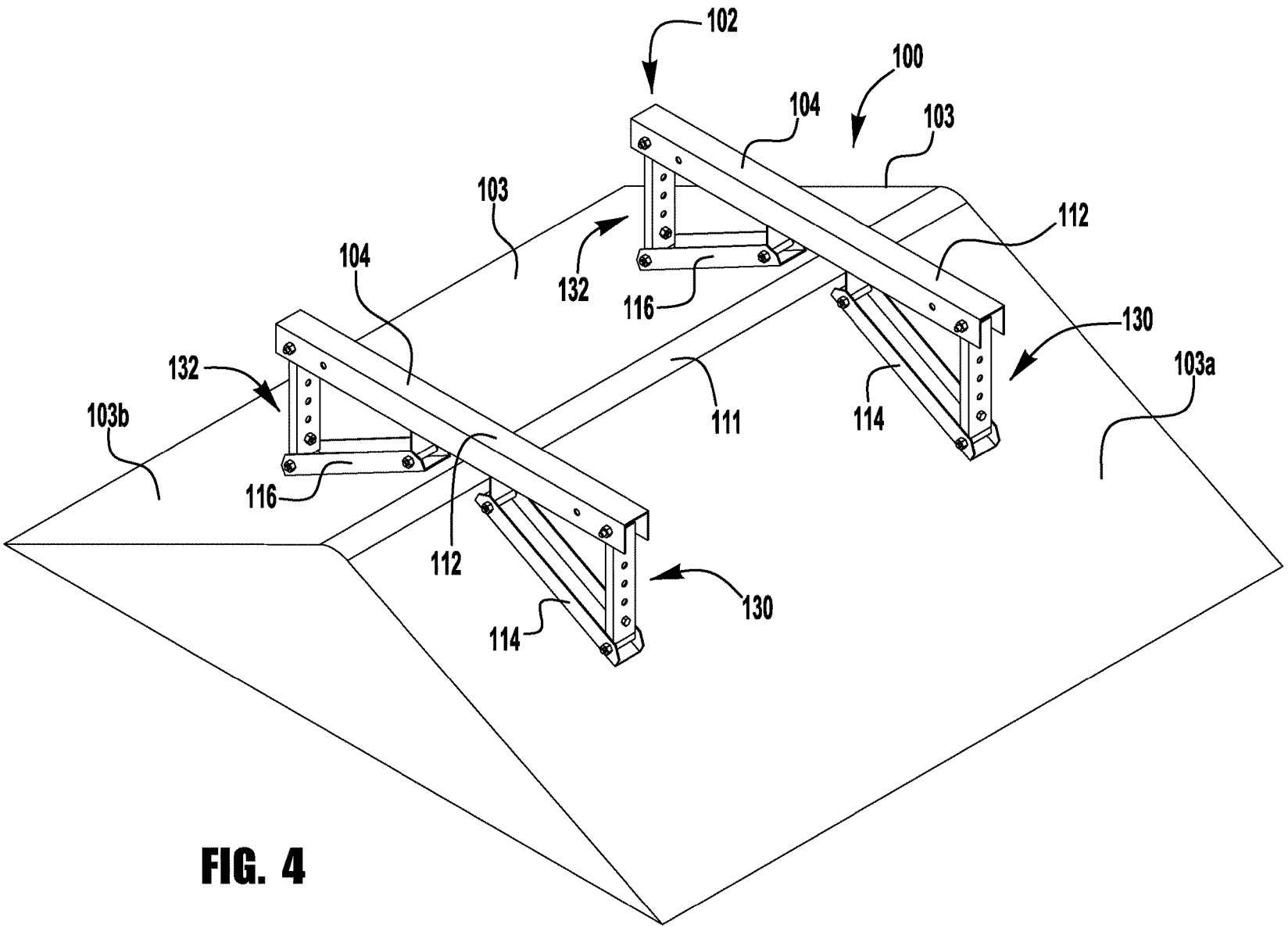
FIG. 4 is a front three-dimensional view of a second embodiment of a roofing shingle delivery system disposed on a roof of a house, in accordance with the present invention.
Figure 7:
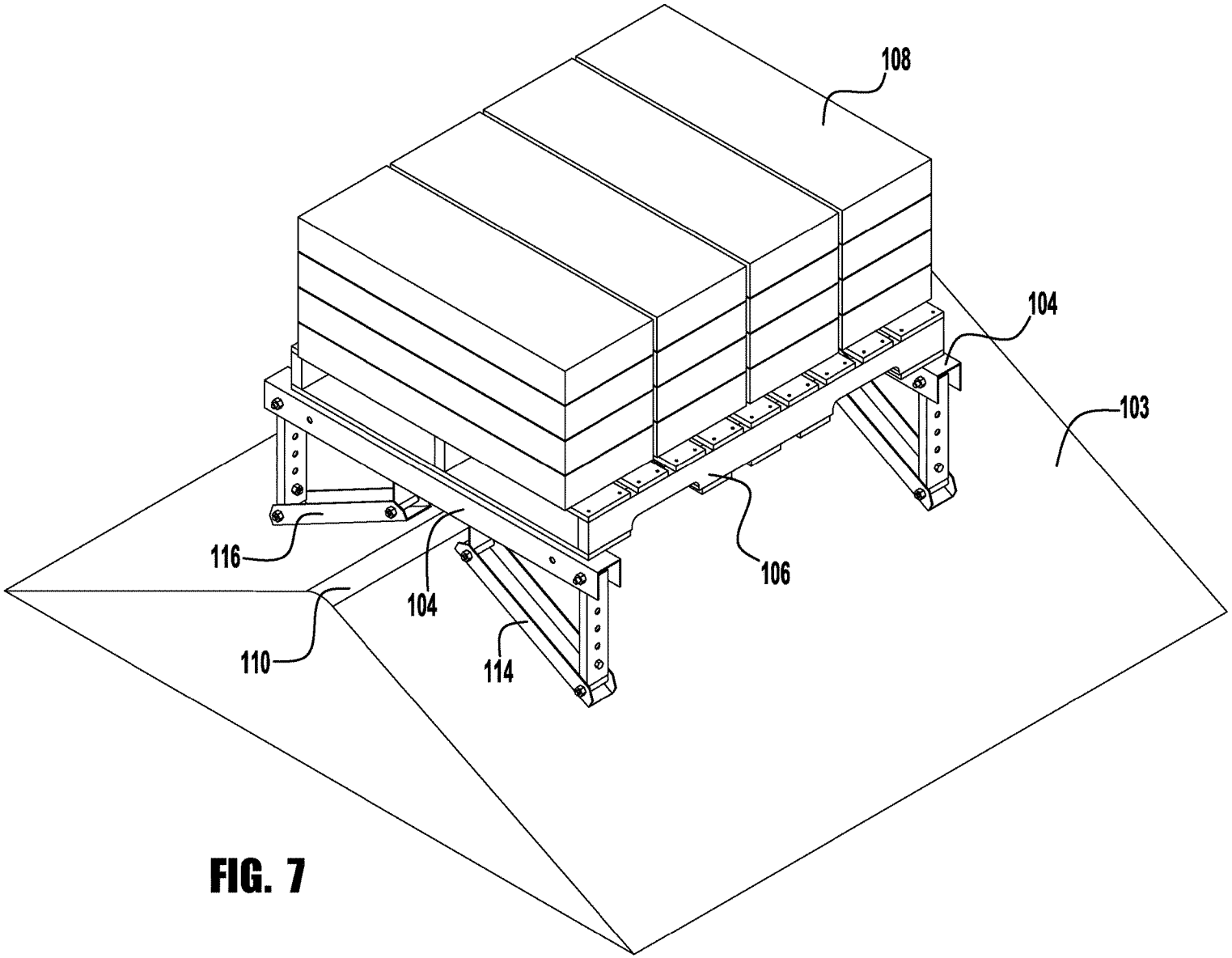
FIG. 7 is a three-dimensional view of the second embodiment of the roofing shingle delivery device in use with a pallet disposed thereon, in accordance with the present invention.

A second embodiment of a roofing shingle delivery system 100, as shown in FIG. 4, is designed to incorporate an adjustable bracket system 102 to sit directly on a roof, such as on a peaked roof 103. In general terms, the adjustable bracket system 102 includes a pair of adjustable brackets 104 disposed on the peaked roof 103 of a house where roofing work is being done. It is within the terms of the embodiment that the pair of brackets 104 be interconnected, such as with a supporting brace (not shown) connecting the ends of the brackets to each other. However, as illustrated, the pair of adjustable brackets 104 are independent from each other. The adjustable brackets 104, comprising the roofing shingle delivery system 100, are designed to support a traditional pallet 106 loaded with roofing shingles 108, as shown in FIG. 7. As seen in FIG. 4, in use, each of the brackets 104 are disposed straddling the peak or ridge 110 of the roof 106 with opposite ends of the brackets 104 resting on opposite sides 103*a* and 103*b*, respectively, of the roof.

Each of the pair of brackets 104 are made of a rigid material, such as for example metal, wood, plastic, or rigid cardboard. Alternatively, the brackets 104 may be made of a biodegradable material, such as for example a wood species easily biodegradable, a biodegradable plastic or a biodegradable cardboard.

As illustrated in FIG. 4, each of the brackets 104 is comprised of an elongated upper member 112 designed to be disposed in a perpendicular relationship with respect to the ridgeline 110 of the roof 103. The brackets 104 include a first lower support brace 114 and a second lower support brace 116 which are disposed so as to rest directly against the surface of the opposite sides 103*a* and 103*b*, respectively, of the roof 103. The pallet 106 containing the roofing shingles 108 is temporarily disposed atop the elongated upper members 112 of each of the pair of brackets 104. The horizontal upper members 112 may have any appropriate dimensions to accommodate the pallet 106.

Figure 5:
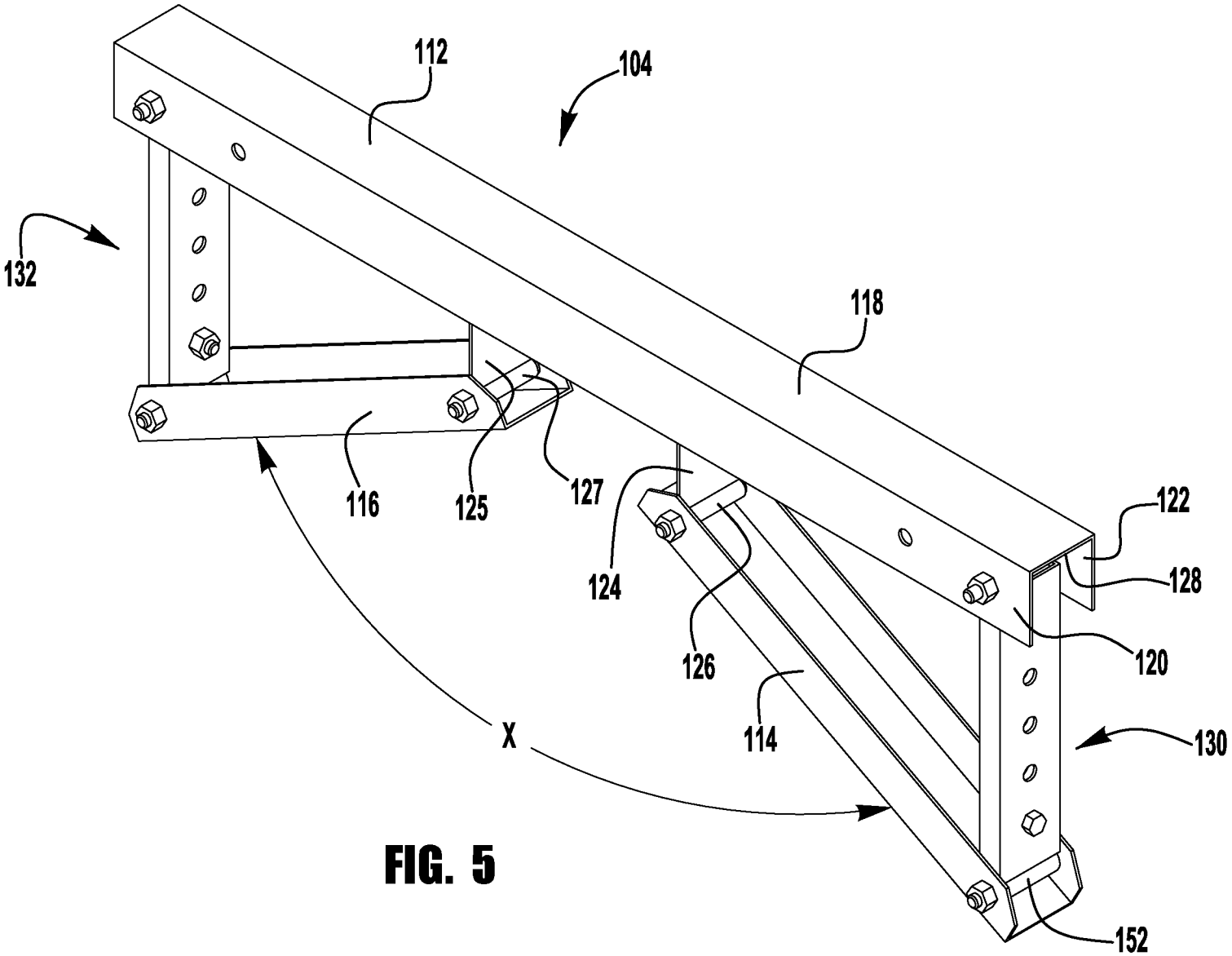
FIG. 5 is a front three-dimensional view of one of the pair of brackets of the second embodiment of the roofing shingle delivery device shown in FIG. 4, in accordance with the present invention.
Figure 6:
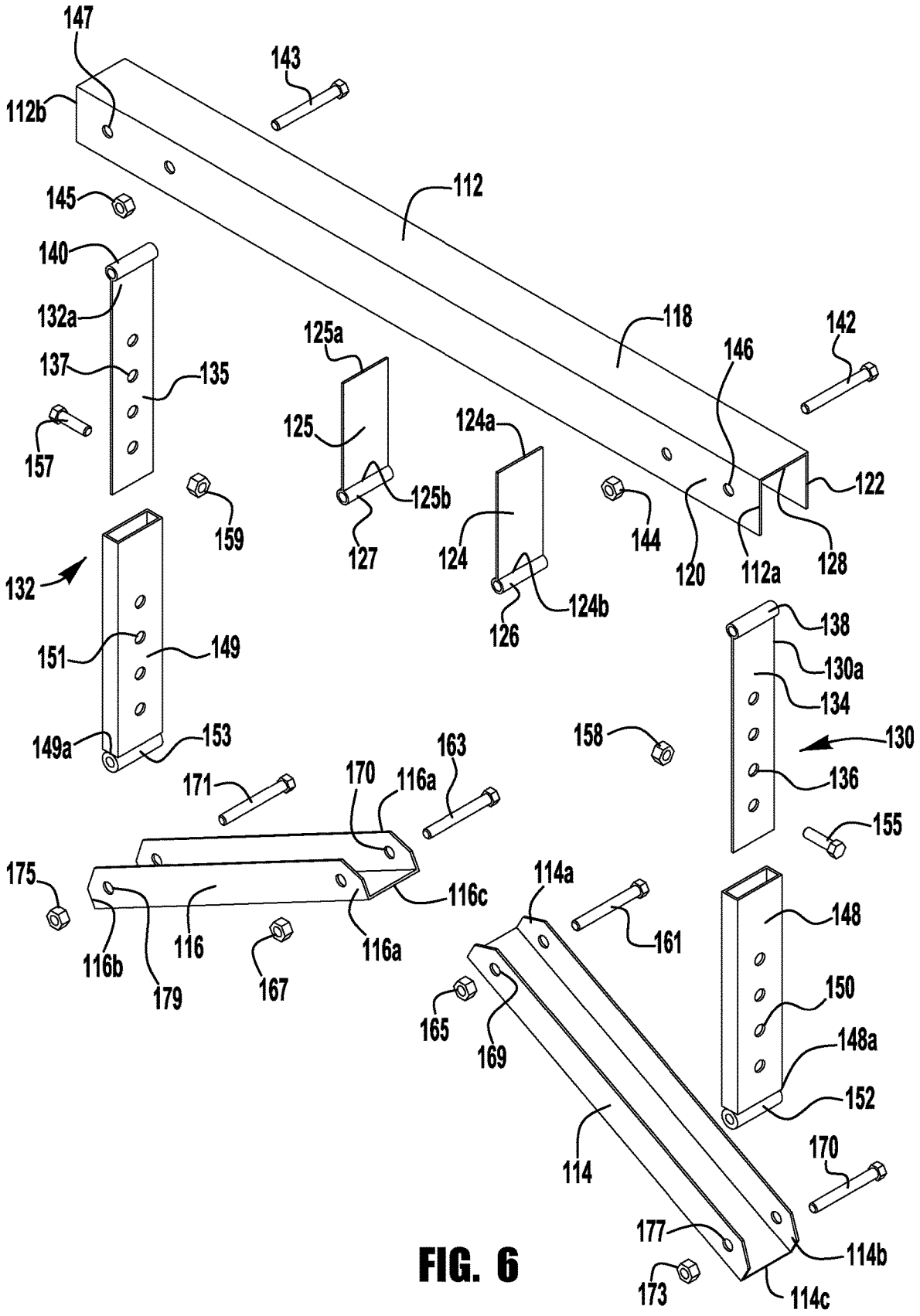
FIG. 6 is a three-dimensional, exploded view of one of the pair of brackets of the second embodiment of the roofing shingle delivery device of FIG. 5, in accordance with the present invention.

Each upper member 112, as shown in FIGS. 5 and 6, is comprised of a C shaped channel constructed of an upper, flat platform surface 118 with walls 120 and 122 extending downward and generally perpendicular to the upper platform surface 118. A pair of struts 124 and 125 are permanently mounted at one end, 124*a* and 125*a*, such as by welding, to the inner bottom surface 128 of the upper member 112, and possibly to the inner surfaces of the walls 120 and 122, as can be understood with FIG. 6. The opposite end 124*b* and 125*b* of the first pair of struts 124 and 125 has a hollow cylindrical tube 126 and 127, respectively, secured thereto. The hollow cylindrical tubes 126 and 127 receive a bolt therethrough as discussed in more detail herein after.

Each of the elongated upper members 112 has a pair of support members 130 and 132 which are secured at a first end 130*a* and 132*a*, respectively, to a first end 112*a* and the second end 112*b*, respectively, of the elongated upper members 112. Each of the pair support members 130 and 132 is constructed of an elongated strip 134 and 135, respectively, with a plurality of spaced holes 136 and 137 therethrough. A hollow cylindrical tube 138 and 140 are secured to the first end 130*a* and 132*a*, respectively, thereof. The hollow cylindrical tubes 138 and 140 receive a bolt 142 and 143, respectively, therethrough, and are secured in place with a nut 144 and 145, respectively, so that the support members 130 and 132 can pivot in the holes 146 and 147 through the walls 120 and 122, with respect to the first end 112*a* and the second end 112*b*, respectively, of the elongated upper members 112, as discussed in more detail herein after.

The elongated strips 134 and 135 are received in a rectangular shaped tube 148 and 149, respectively, having a plurality of spaced holes 150 and 151 therethrough. The bottom end 148*a* and 149*a*, respectively, has a hollow cylindrical tube 152 and 153 secured thereto for attachment to a first lower support brace 114 and a second lower support brace 116, respectively. The length of the support members 130 and 132 can be adjusted by aligning the holes 136 and 137 in the elongated strips 134 and 135, with the holes 150 and 151 in rectangular shaped tube 148 and 149, respectively, and then inserting a bolt 155 and 157, respectively, therethrough, and securing them in place with a nut 158 and 159 to the lower support brace 114 and second lower support brace 116.

The lower support braces 114 and 116 are each secured at a first end 114*a* and 116*a* to the hollow cylindrical tube 126 and 127 at the opposite ends 124*b* and 125*b* of the first pair of struts 124 and 125 by a bolt 161 and 163 and nut 165 and 167 through holes 169 and 170 which extend through the sidewalls of the support braces.

The lower support braces 114 and 116 are each secured at a second end 114*b* and 116*b* to the hollow cylindrical tube 152 and 153 at the opposite ends 148*a* and 148*b* of the support members 130 and 132 by a bolt 170 and 171 and nuts 173 and 175 through holes 177 and 179 which extend through the sidewalls of the support braces.

The angle X between the support braces 114 and 116 can be adjusted by changing the length of the support members 130 and 132. This is easily accomplished by repositioning the elongated strips 134 and 135 within the rectangular shaped tubes 148 and 149. Preferably, the elongated strips 134 and 135 are positioned so that the outward facing surface 114*c* and 116*c* of the support braces 114 and 116 are disposed flat against the sides 103*a* and 103*b* of the roof 103.

The brackets 104 are customizable to be functional on a variety of roofs 103 having various levels of pitch. The angled section of the first lower support braces 114 and 116 have an angle of X degrees between them. The angle X is adjustable to accommodate various pitches of the opposite sides 103*a* and 103*b* of the roof 103. To adjust the angle X, position of the support braces 114 and 116 may be customized.

For example, the length of the support members 130 and 132 can be adjusted by aligning the holes 136 and 137 with the holes 150 and 151 to lengthen or shorten the support members to accommodate the specific pitch of the roof 103. Each of the support braces 114 and 116 are disposed relative to the other to form an angle of a range of angles from 0 to 180 degrees, thereby forming a selected angle which corresponds to the angle defined by the roof peak.

An embodiment of the roofing shingle delivery system 100 is designed to provide is a bracket system to sit directly on the peak of a peaked roof 103. In general terms, a pair of brackets 104 is disposed on the peaked roof of a house where roofing work is being done. It is within the terms of the embodiment that the pair of brackets 104 be interconnected, such as with a supporting brace connected at either end to the brackets. However, as illustrated, the pair of brackets 104 are independent from each other. The brackets 104, comprising the roofing shingle delivery system 100, are designed to support a traditional pallet 106 containing the roofing shingles 108, as shown in FIG. 7. As seen in FIG. 4, each of the brackets 104 are disposed straddling the peak or ridge 111 of a roof 103 with opposite sides of the brackets 104 resting on opposite sides 103*a* and 103*b*, respectively, of the roof.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A roofing shingle delivery system for supporting a pallet on a surface of a peaked roof, comprising:

two adjustable brackets configured to support the pallet on the peaked roof;

wherein each of the adjustable brackets comprising:

an elongated upper member;

a first lower support brace pivotally mounted to the elongated upper member, a second lower support brace pivotally mounted to the elongated upper member, a first strut pivotally connecting the elongated upper member to the first lower support brace;

a second strut pivotally connecting the elongated upper member to the second lower support brace;

a first support member pivotally connected to the elongated upper member and pivotally connected to the first lower support brace; and a second support member pivotally connected to the elongated upper member and pivotally connected to the second lower support brace;

wherein the first lower support brace and the second lower support brace of each of the adjustable brackets are configured to be seated on opposite sides of the peaked roof;

wherein the elongated upper member of each of the adjustable brackets defines a channel, the channel comprises an upper flat platform surface and two sidewalls extending downward from the upper flat platform surface, and the two sidewalls of the channel are generally perpendicular to the upper flat platform surface of the channel;

wherein in each of the adjustable brackets, one end of the first strut and one end of the second strut are welded to an inner bottom surface and the two side walls of the channel;

wherein in each of the adjustable brackets, one end of the first support member is pivotally secured to a first end of the elongated upper member, and one end of the second support member is pivotally secured to a second end of the elongated upper member;

wherein in each of the adjustable brackets, the first support member comprises a first rectangular shaped tube, a first elongated strip sleeved in the first rectangular shaped tube, and a first hollow cylindrical tube fixed to one end of the first elongated strip;

wherein both the first rectangular shaped tube and the first elongated strip define through holes arranged at intervals, and the through holes of the first rectangular shaped tube are matched with the through holes of the first elongated strip;

wherein in each of the adjustable brackets, the second support member comprises a second rectangular shaped tube, a second elongated strip sleeved in the second rectangular shaped tube, and a second hollow cylindrical tube fixed to one end of the second elongated strip; and wherein both the second rectangular shaped tube and the second elongated strip define through holes arranged at intervals, and the through holes of the second rectangular shaped tube are matched with the through holes of the second elongated strip.

2. The roofing shingle delivery system of claim 1, wherein the two adjustable brackets are independent from each other.

3. The roofing shingle delivery system of claim 2, wherein each of the adjustable brackets are designed to be temporarily disposed straddling the peaked roof with opposite ends of the adjustable brackets resting on the opposite sides of the peaked roof to support the pallet loaded with roofing shingles.

4. The roofing shingle delivery system of claim 3, wherein the elongated upper member of each of the adjustable brackets is perpendicular to a ridgeline of the peaked roof.

5. A roofing shingle delivery system for supporting a pallet on a surface of a peaked roof, comprising;

two adjustable brackets configured to support the pallet on the peaked roof;

wherein each of the adjustable brackets comprising:

an elongated upper member;

a first lower support brace pivotally mounted to the elongated upper member, a second lower support brace pivotally mounted to the elongated upper member, a first strut pivotally connecting the elongated upper member to the first lower support brace;

a second strut pivotally connecting the elongated upper member to the second lower support brace;

a first support member pivotally connected to the a first end of the elongated upper member and pivotally connected to the first lower support brace; and a second support member pivotally connected to a second end of the elongated upper member and pivotally connected to the second lower support brace;

wherein the first lower support brace and the second lower support brace of each of the adjustable brackets are configured to respectively abut against surfaces of opposite sides of the peaked roof;

wherein in each of the adjustable brackets, an angle X between the first lower support brace and the second lower support brace is allowed to be adjusted by adjusting a length of the first support member and a length of the second support member;

wherein the elongated upper member of each of the adjustable brackets defines a channel, the channel comprises an upper flat platform surface and two sidewalls extending downward from the upper flat platform surface, and the two sidewalls of the channel are generally perpendicular to the upper flat platform surface of the channel;

wherein in each of the adjustable brackets, one end of the first strut and one end of the second strut are welded to an inner bottom surface and the two side walls of the channel;

wherein in each of the adjustable brackets, the first support member comprises a first rectangular shaped tube, a first elongated strip sleeved in the first rectangular shaped tube, and a first hollow cylindrical tube fixed to one end of the first elongated strip;

wherein both the first rectangular shaped tube and the first elongated strip define through holes arranged at intervals, and the through holes of the first rectangular shaped tube are matched with the through holes of the first elongated strip;

wherein in each of the adjustable brackets, the second support member comprises a second rectangular shaped tube, a second elongated strip sleeved in the second rectangular shaped tube, and a second hollow cylindrical tube fixed to one end of the second elongated strip; wherein both the second rectangular shaped tube and the second elongated strip define through holes arranged at intervals, and the through holes of the second rectangular shaped tube are matched with the through holes of the second elongated strip.

6. The roofing shingle delivery system of claim 5, wherein the length of the first support member is adjusted by adjusting a position of the first elongated strip with respect to the first rectangular shaped tube, and the length of the second support member is adjusted by adjusting a position of the second elongated strip with respect to the second rectangular shaped tube, so that the angle X between the first lower support brace and the second lower support brace is adjusted.

7. The roofing shingle delivery system of claim 6, wherein the first elongated strip is positioned in the first rectangular shaped tube through a first bolt, and the second elongated strip is positioned in the second rectangular shaped tube through a second bolt, so that the first lower support brace and the second lower support brace are configured to be abutted against the surfaces of the opposite sides of the peaked roof.

* * * * *